United States Patent [19]

Clarke et al.

[11] Patent Number: 5,052,250

[45] Date of Patent: Oct. 1, 1991

[54] STARTER PLUG

[76] Inventors: Walter G. Clarke, 27 White Oak Dr., Newport News, Va. 23601; George Spector, 233 Broadway Rm 3815, New York, N.Y. 10007

[21] Appl. No.: 167,047

[22] Filed: Mar. 11, 1988

[51] Int. Cl.[5] ..... B25B 13/30

[52] U.S. Cl. ..... 81/114; 81/128; 279/42; 279/48; 294/100

[58] Field of Search ..... 81/112–115, 81/128; 279/42, 48, 56, 69; 294/19.1, 24, 99.1, 99.2, 100

[56] References Cited

U.S. PATENT DOCUMENTS

| | | | |
|---|---|---|---|
| 1,690,018 | 10/1928 | Kerfoot | 81/114 |
| 2,561,407 | 7/1951 | Palmer | 279/42 X |
| 2,669,896 | 2/1954 | Clough | 81/128 |
| 2,862,411 | 12/1958 | Deliso | 81/114 |
| 3,738,768 | 6/1973 | Kuhn | 279/42 X |

FOREIGN PATENT DOCUMENTS

| | | | |
|---|---|---|---|
| 1334452 | 7/1963 | France | 81/112 |
| 492799 | 4/1954 | Italy | 81/112 |

*Primary Examiner*—James G. Smith
*Attorney, Agent, or Firm*—Wallace J. Nelson

[57] ABSTRACT

A spark plug starter tool is provided and consists of a spark plug engaging member attached to distal end of an elongated flexible shaft affixed onto a dowel pin extending from a handle whereby turning of the handle will install and remove a spark plug with respect to a cylinder head of an engine thus eliminating cross-threading. In a modification an adjustable chuck head is on distal end of a rigid shaft so that the chuck head can grasp and release the spark plug.

2 Claims, 1 Drawing Sheet

STARTER PLUG

BACKGROUND OF THE INVENTION

The instant invention relates generally to tools and more specifically it relates to a spark plug starter tool.

Numerous tools have been provided in prior art that are adapted to contain a long flexible shank portion which can be bent to any angle. For example, U.S. Pat. Nos. 2,814,224; 3,585,885 and 3,788,168 all are illustrative of such prior art. While these units may be suitable for the particular purpose to which they address, they would not be as suitable for the purposes of the present invention as heretofore described.

SUMMARY OF THE INVENTION

A primary object of the present invention is to provide a spark plug starter tool that will overcome the shortcomings of the prior art devices.

Another object is to provide a spark plug starter tool that will install and remove the spark plug with respect to a cylinder head of an engine thus eliminating cross-threading.

An additional object is to provide a spark plug starter tool that includes a flexible shaft which can install a spark plug into a hand to reach a place on the cylinder head of the engine.

A further object is to provide a spark plug starter tool that is simple and easy to use.

A still further object is to provide a spark plug starter tool that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

DESCRIPTION OF THE DRAWING FIGURES

DETAILED DESCRIPTION OF THE PREFERRED EMBODIMENTS

Figure 1:
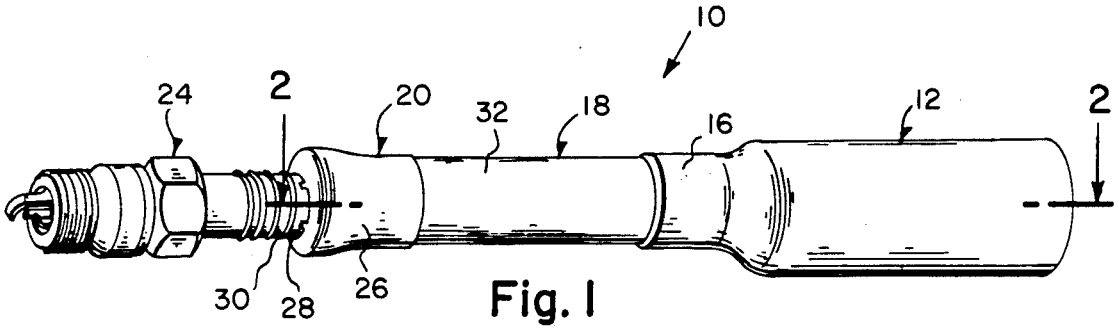
FIG. 1 is a perspective view of the invention holding a spark plug.
Figure 2:
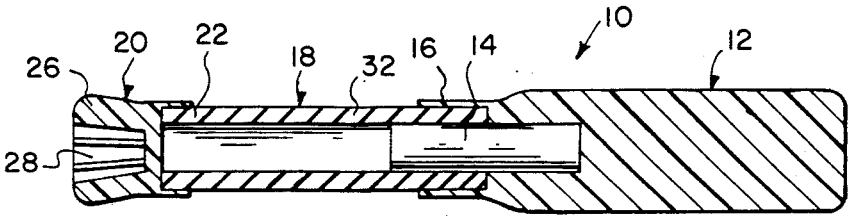
FIG. 2 is a cross sectional view taken along line 2—2 in FIG. 1.

Turning now descriptively to the drawings, in which similar reference characters denote similar elements throughout the several views, FIG. 1 and 2 illustrate a spark plug starter tool 10. A handle 12 is provided with a rigid dowel pin 14 extending outwardly from one end 16 of the handle 12. An elongated flexible shaft 18 is affixed onto the dowel pin 14 and extends outwardly from the one end 16 of the handle 12. A spark plug engaging member 20 is attached to distal end 22 of the elongated flexible shaft 18, whereby turning of the handle 12 will install and remove a spark plug 24 with respect to a cylinder head of an engine (not shown) thus eliminating cross-threading.

The spark plug engaging member 20 is a rubber grip head 26 having a splined aperture 28 which grips molded insulator 30 of the spark plug 24. The flexible shaft 18 is a rubber tube 32 which can be bent for installing the spark plug 24 into a hand to reach place on the cylinder head of the engine.

Figure 3:
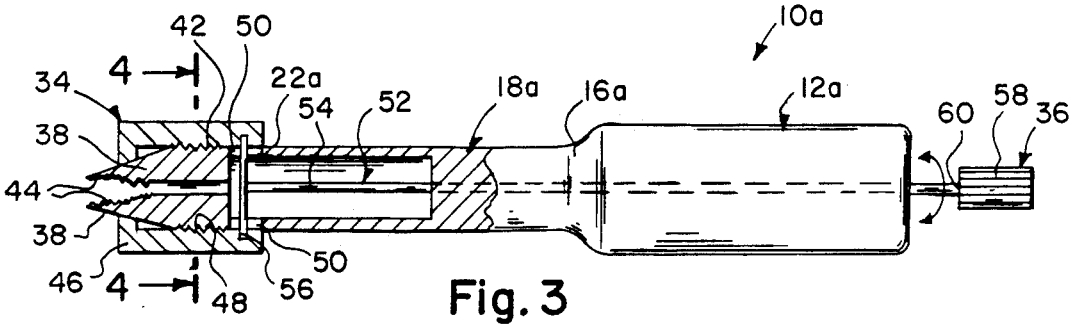
FIG. 3 is a side view with parts in section of a modification in which there is an adjustable chuck head for grasping the spark plug.
Figure 4:
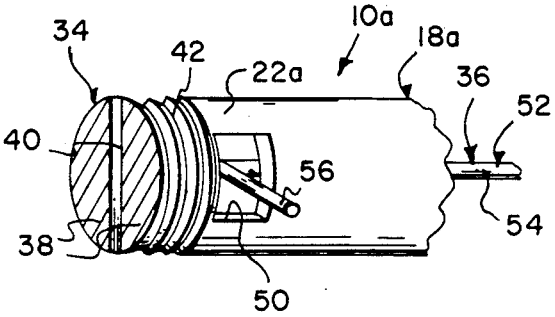
FIG. 4 is a fragmentary perspective view taken in direction of line 4—4 in FIG. 3, showing details of the transverse large aperture in the shaft with the T-shaped rod therethrough.

FIGS. 3 and 4 illustrate a modified spark plug starter tool 10*a*. A handle 12*a* is provided with an elongated rigid shaft 18*a* formed to and extending outwardly from one end 16*a* of the handle 12*a*. An adjustable chuck head 34 is on distal end 22*a* of the rigid shaft 18*a*. A device 36 is also provided for operating the chuck head 34 so that the chuck head can grasp and release spark plug 24. Turning of the handle 12*a* will install and remove the spark plug 24 with respect to the cylinder head of the engine (not shown) thus eliminating cross-threading.

The adjustable chuck head 34 includes a pair of jaws 38 formed on the distal end 22*a* of the rigid shaft 18*a*. The jaws 38 have a slot 40 therebetween, external threads 42 thereon and internal gripping surfaces 44. A shell 46 is provided having internal threads 48 is threaded onto the jaws 38. When the shell 46 is turned in one direction the jaws 38 will open and when the shell 46 is turned in an opposite direction the jaws 38 will close.

The operating device 36 includes the rigid shaft 18*a* having a pair of transverse large apertures 50 at the distal end 22*a* thereof adjacent the jaws 38 and an elongated T-shaped rod 52. The rod 52 has a long segment 54 and a short segment 56. The long segment 54 extends axially through the handle 12*a* and the rigid shaft 18*a*, while the short segment 56 extends through the large apertures 50 in the rigid shaft 18*a* and into the shell 46 of the adjustable chuck head 34.

A control knob 58 is affixed to free end 60 of the long segment 54 of the T-shaped rod 52 rearwardly of the handle 12*a* so that turning of the control knob 58 will operate the adjustable chuck head 34.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A spark plug starter tool which comprises:

a) a handle;

b) an elongated rigid shaft formed to and extending outwardly from one end of said handle;

c) an adjustable chuck head on the distal end of said rigid shaft;

said adjustable chuck head including:

a) a pair of adjustable jaws formed on the distal end of said rigid shaft, said jaws having a slot therebetween, external threads thereon and internal gripping surfaces; and b) a shell having internal threads threaded onto said jaws and a portion adapted to move said jaws together whereby when said shell is turned in one direction said jaws will remain open and when said shell is turned in an opposite direction said portion will move said jaws together;

d) means for operating said adjustable chuck head so that said chuck head can grasp and release a spark plug, whereby turning of said handle will install and remove the spark plug with respect to a cylinder head of an engine thus eliminating cross-threading;

said means for operating said chuck head including a central T-rod; said T-rod including a short transverse segment disposed within and extending through large apertures provided within diametrically opposed sides of said rigid shaft and into said shell, and a long segment extending axially through said rigid shaft and said handle, a control knob affixed to the free end of said long segment exteriorly adjacent said handle whereby turning of said control knob will operate said adjustable chuck head to adjust the relative position of said jaws.

2. A spark plug starter tool which comprises:

a) a handle;

b) an elongated rigid shaft formed to and extending outwardly from one end of said handle;

c) an adjustable chuck head on the distal end of said rigid shaft;

d) means for operating said adjustable chuck head so that said chuck head can grasp and release a spark plug, whereby turning of said handle will install and remove the spark plug with respect to a cylinder head of an engine thus eliminating cross-threading; wherein said adjustable chuck head includes:

a) a pair of adjustable jaws formed on the distal end of said rigid shaft, said jaws having a slot therebetween, external threads thereon and internal gripping surfaces;

b) a shell having internal threads threaded onto said jaws and a portion adapted to move said jaws together whereby when said shell is turned in one direction said jaws will remain open and when said shell is turned in an opposite direction said portion will move said jaws together;

e) said means for operating said chuck head including;

a) said rigid shaft having a pair of transverse large apertures at the distal end thereof adjacent said jaws;

b) an elongated T-shaped rod having a long segment and a short segment, said long segment extends axially through said handle and said rigid shaft while said short segment extends through said large apertures in said rigid shaft and into said shell of said adjustable chuck head; and c) a control knob affixed to the free end of said long segment of said T-shaped rod rearwardly of said handle so that turning of said control knob will operate said adjustable chuck head to adjust the relative position of said jaws.

* * * * *